US005951790A

United States Patent [19]

Mannava et al.

[11] Patent Number: 5,951,790

[45] Date of Patent: Sep. 14, 1999

[54] METHOD OF MONITORING AND CONTROLLING LASER SHOCK PEENING USING AN IN PLANE DEFLECTION TEST COUPON

[75] Inventors: Seetharamaiah Mannava, Cincinnati; William D. Cowie, Xenia; P. Kennard Wright, III; Robert D. McClain, both of Cincinnati, all of Ohio

[73] Assignee: General Electric Company, Cincinnati, Ohio

[21] Appl. No.: 09/107,196

[22] Filed: Jun. 26, 1998

[51] Int. Cl.[6] ..... C21D 1/54

[52] U.S. Cl. ..... 148/510; 148/900; 148/903

[58] Field of Search ..... 148/508, 510, 148/900, 903

[56] References Cited

U.S. PATENT DOCUMENTS

| | | | |
|---|---|---|---|
| 2,620,838 | 12/1952 | Huyett et al. . | |
| 2,958,925 | 11/1960 | Roberts . | |
| 3,695,091 | 10/1972 | Smith . | |
| 3,850,698 | 11/1974 | Mallozzi et al. | 148/903 |
| 4,937,421 | 6/1990 | Ortiz, Jr. et al. | 219/121.68 |
| 5,160,822 | 11/1992 | Aleshin . | |
| 5,297,418 | 3/1994 | Champaigne . | |
| 5,591,009 | 1/1997 | Mannava et al. . | |
| 5,625,664 | 4/1997 | Berkley . | |
| 5,674,328 | 10/1997 | Mannava et al. . | |
| 5,674,329 | 10/1997 | Mannava et al. . | |
| 5,730,811 | 3/1998 | Azad et al. . | |
| 5,735,044 | 4/1998 | Ferrigno et al. . | |
| 5,741,559 | 4/1998 | Dulaney . | |

OTHER PUBLICATIONS

"The Development of New Type Almen Strip for Measurement of Peening Intensity on Hard Shot Peening", by Y. Watanabe, K. Namiki, Sep., 1992, 6 pages.

"New Results In Measuring The Shot Peen Interface In Ti6A14V", by Eddy Current, Jul., 1991, 11 pages.

"X–Ray Diffraction Characterization of Residual Stresses Produced by Shot Peening", by Paul S. Prevey, pp. 82–93. No Date.

"Full Assurance Shot Peening Of Aircraft Gas Turbine Engine Components", by PG Bailey, DR Lombardo, HG Popp, RA Thompson, Dec. 1996, pp. 320–327.

"Residual Stress Measurement For Quality Control Of Shot Peening", by Lambda Research, 2 pages. No Date.

*Primary Examiner*—Scott Kastler
*Attorney, Agent, or Firm*—Andrew C. Hess; Nathan D. Herkamp

[57] ABSTRACT

A method for quality assurance of a laser process and more particularly a laser shock peening process that uses a test coupon having a deflection formed by a laser firing. The test coupon is from a metallic strip having opposite first and second sides that generally define a plane of the strip and the strip includes a laser shock peened patch of the strip that has first and second laser shock peened surfaces on the first and second sides, respectively, first and second laser shocked regions having deep compressive residual stresses imparted by the laser shock peening extending into the strip from the first and second laser shock peened surfaces, respectively, and a deflection of a portion of the strip from a position of the portion before the laser shock peening. The deflection is formed by the laser shock peening such that at least a part and preferably substantially all of the deflection lies in the plane of the strip and the test coupon preferably includes an indicating means to indicate the deflection. The quality assurance process of the present invention may further include correlating high cycle fatigue to the deflection.

23 Claims, 8 Drawing Sheets

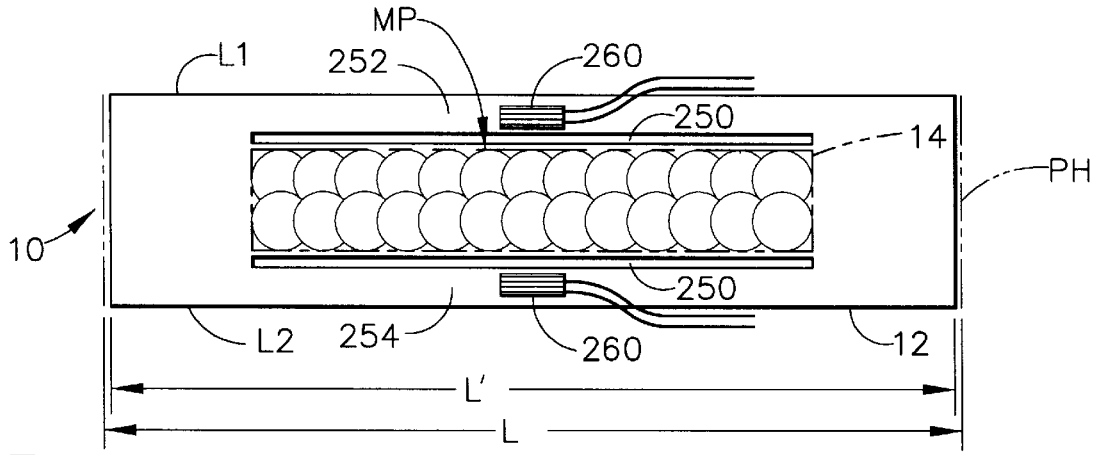
FIG. 4 $\delta = L - L'$
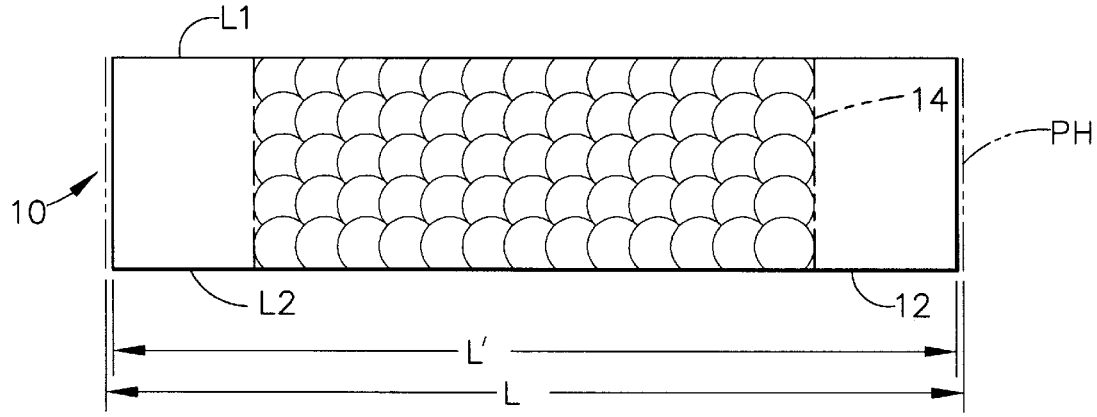
FIG. 4A $\delta = L - L'$

METHOD OF MONITORING AND CONTROLLING LASER SHOCK PEENING USING AN IN PLANE DEFLECTION TEST COUPON

RELATED PATENT APPLICATIONS

The present application deals with related subject matter in co-pending U.S. patent application Ser. No. 09/106,320 filed Jun. 29, 1998 entitled "IN PLANE DEFLECTION COUPON FOR MONITORING AND CONTROLLING OF LASER SHOCK PEENING".

BACKGROUND OF THE INVENTION

1. Field of the Invention

This invention relates to quality assurance methods, apparatus, and articles of manufacture used for quality assurance of surface treatment of a substrate surface such as peening and, more particularly, to using in plane coupon deflection or bending of a metal coupon or strip for quality assurance of laser shock peening processes.

2. Description of Related Art

Laser shock peening or laser shock processing, as it is also referred to, is a process for producing a region of deep compressive residual stresses imparted by laser shock peening a surface area of a workpiece. Laser shock peening typically uses multiple radiation pulses from high power pulsed lasers to produce shock waves on the surface of a workpiece similar to methods disclosed in U.S. Pat. No. 3,850,698, entitled "Altering Material Properties"; U.S. Pat. No. 4,401,477, entitled "Laser Shock Processing"; and U.S. Pat. No. 5,131,957, entitled "Material Properties". Laser shock peening, as understood in the art and as used herein, means utilizing a laser beam from a laser beam source to produce a strong localized compressive force on a portion of a surface by producing an explosive force by instantaneous ablation or vaporization of a painted or coated or un-coated surface. Laser peening has been utilized to create a compressively stressed protection layer at the outer surface of a workpiece which is known to considerably increase the resistance of the workpiece to fatigue failure as disclosed in U.S. Pat. No. 4,937,421, entitled "Laser Peening System and Method". These methods typically employ a curtain of water flowed over the workpiece or some other method to provide a confining medium to confine and redirect the process generated shock waves into the bulk of the material of a component being LSP'D to create the beneficial compressive residual stresses.

Laser shock peening is being developed for many applications in the gas turbine engine field, some of which are disclosed in the following co-pending U.S. patent application Ser. No. 08/362,362 entitled "ON THE FLY LASER SHOCK PEENING", filed Dec. 22, 1994; and U.S. Pat. No. 5,591,009, entitled "Laser shock peened gas turbine engine fan blade edges"; U.S. Pat. No. 5,569,018, entitled "Technique to prevent or divert cracks"; U.S. Pat. No. 5,531,570, entitled "Distortion control for laser shock peened gas turbine engine compressor blade edges"; U.S. Pat. No. 5,492,447, entitled "Laser shock peened rotor components for turbomachinery"; 5,674,329, entitled "Adhesive tape covered laser shock peening"; and U.S. Pat. No. 5,674,328, entitled "Dry tape covered laser shock peening", all of which are assigned to the present Assignee. These applications, as well as others, are in need of efficient quality assurance testing during production runs using laser shock peening.

Laser shock peening processes have been developed to simultaneously LSP pressure and suction sides of leading and trailing edges of fan and compressor airfoils and blades as disclosed in U.S. Pat. No. 5,591,009 entitled "Laser shock peened gas turbine engine fan blade edges" and U.S. Pat. No. 5,531,570 entitled "Distortion control for laser shock peened gas turbine engine compressor blade edges". Almen strips have been used in conventional methods to assess the quality of shot peening processes. Though relatively inexpensive and easy to use, such a process is not suitable because it relies on out of plane bending of the strip. Out of plane bending essentially would not occur with a dual sided and/or simultaneous LSP process because there would be substantially equal compressive residual stresses imparted to both sides of such an Almen strip.

Typically, a flat Almen strip is secured in a holder which constrains the strip to prevent the strip from bending. The strip is subjected to a shot peening regimen after which the strip is removed from the holder. Stresses induced in the strip by the surface shot peening cause the strip to curve out of the plane of the flat strip when removed from the constraints of the holder. Hence, the terms out of plane and in plane as used herein. The curved strip is then typically placed in a peening-intensity gage which measures the amount of out of plane deflection or bending of the strip also referred to as the curvature of the strip. This deflection gives a qualitative indication of the amount of residual stress that is in the Almen strip, though there is no direct quantitative correlation to the residual stress measurement from the measured deflection.

Conventional high cycle fatigue (HCF) testing of blades which are LSP'd and notched before testing has been tried as a quality assurance technique. Measurement of the diameter and volume of a single LSP spot on a flat coupon by optical interferometry has also been tried for QA purposes. Both of these methods are fairly expensive and time consuming to carry out and significantly slows production and the process of qualifying LSP'd components. An improved quality assurance apparatus and method of measurement and control of LSP is required which is inexpensive, accurate, and quick. LSP is a process that, as any production technique, involves machinery and is time consuming and expensive. Therefore, any techniques that can reduce the amount or complexity of production machinery and/or production time are highly desirable.

SUMMARY OF THE INVENTION

A method for quality assurance of a laser process and more particularly a laser shock peening process uses a test coupon having an plane deflection formed by a laser firing. The test coupon is formed from a metallic strip having opposite first and second sides that generally define the plane of the strip. The strip includes a laser shock peened patch of the strip that has first and preferably second laser shock peened surfaces on the first and second sides respectively, first and second laser shocked regions having deep compressive residual stresses imparted by the laser shock peening extending into the strip from the first and second laser shock peened surfaces respectively. The deflection is of a portion of the strip from a position of the portion before the laser shock peening. The term deflection, for the purpose of this patent, is defined as bending or displacement of at least part of the strip. The deflection is formed by the laser shock peening and at least a part and preferably substantially all of the deflection lies in the plane. Preferably, the first and second laser shock peened surfaces and regions respectively are substantially identical such that the deflection is substantially only in the plane. The first and second laser shock peened surfaces may be simultaneously laser shock peened. The test coupon may further include an indicating means to indicate the deflection.

The patch may be asymmetrically disposed on the strip and the deflection includes a bending of at least a portion of the strip. The strip and sides may be rectangular and have a length and width such that the length is longer than the width, and the patch is disposed asymmetrically with respect to a lengthwise centerline of the strip. The patch may be disposed lengthwise along a lengthwise edge of the strip and extend widthwise inwardly from the lengthwise edge. The deflection is a bending of the strip in the plane of the strip. The indicating means is a displacement of a corner of the strip along the first lengthwise edge of the strip with respect to a centerpoint of the strip along the first lengthwise edge of the strip at a widthwise extending centerline of the strip.

In another embodiment, the strip and sides may be rectangular having a length and width. The strip has lengthwise and widthwise edges, the length and lengthwise edges are longer than the width and the widthwise edges, and a slit extends lengthwise a portion of the length from one of the widthwise edges forming lengthwise bifurcated and non-bifurcated portions of the strip. The bifurcated portion includes two branches separated by the slit of the strip and the patch is disposed on the non-bifurcated portion of the strip wherein the patch extends lengthwise away from the slit. The slit is preferably formed along a lengthwise centerline of the strip. The deflection is a bending of the branches in the plane of the strip. The indicating means is a displacement of a corner of one of the branches along the first lengthwise edge of the strip with respect to a second corner of the strip along the first lengthwise edge of the strip on the non-bifurcated portion of the strip.

In another embodiment, the strip and sides are rectangular and have a length and width such that the length is longer than the width, the deflection includes a lengthwise elongation of the strip, two parallel lengthwise extending slots are disposed through the strip, and the patch is centered between the slots. Strain gauges may be operably disposed on non-laser shock peened portions of the first and second sides and the non-laser shock peened portions are preferably between the slots and the lengthwise edges.

ADVANTAGES

Advantages of the present invention are numerous and include lowering the cost, time, man power and complexity of performing quality assurance tests during laser shock peening processes. Another advantage of the present invention is that it allows performing quality assurance tests during laser shock peening processes at the site of the process and in real time with respect to the processing. The present invention can help greatly reduce the amount of down time for performing quality assurance tests during laser shock peening. The present invention replaces the tedious, costly and time consuming process of notched high cycle fatigue testing presently used for QA. It also allows the coupons to be processed with the same energy, spot pattern and number of layers, if desired, as the workpieces (such as gas turbine engine blades). The QA can be performed in tandem with an actual component or workpiece, thus, allowing a coupon to be reproduced which exactly matches the state of the process for each specific component performed (or components can be qualified on a lot-by-lot basis if desired).

BRIEF DESCRIPTION OF THE DRAWINGS

The foregoing aspects and other features of the invention are explained in the following description, taken in connection with the accompanying drawings where:

FIG. 4 is a schematic view of a test coupon in accordance with an exemplary third embodiment of the present invention.

FIG. 4A is a schematic view of a test coupon in accordance with a variation of the exemplary third embodiment of the present invention illustrated in FIG. 4.

DETAILED DESCRIPTION OF THE INVENTION

Figure 1:
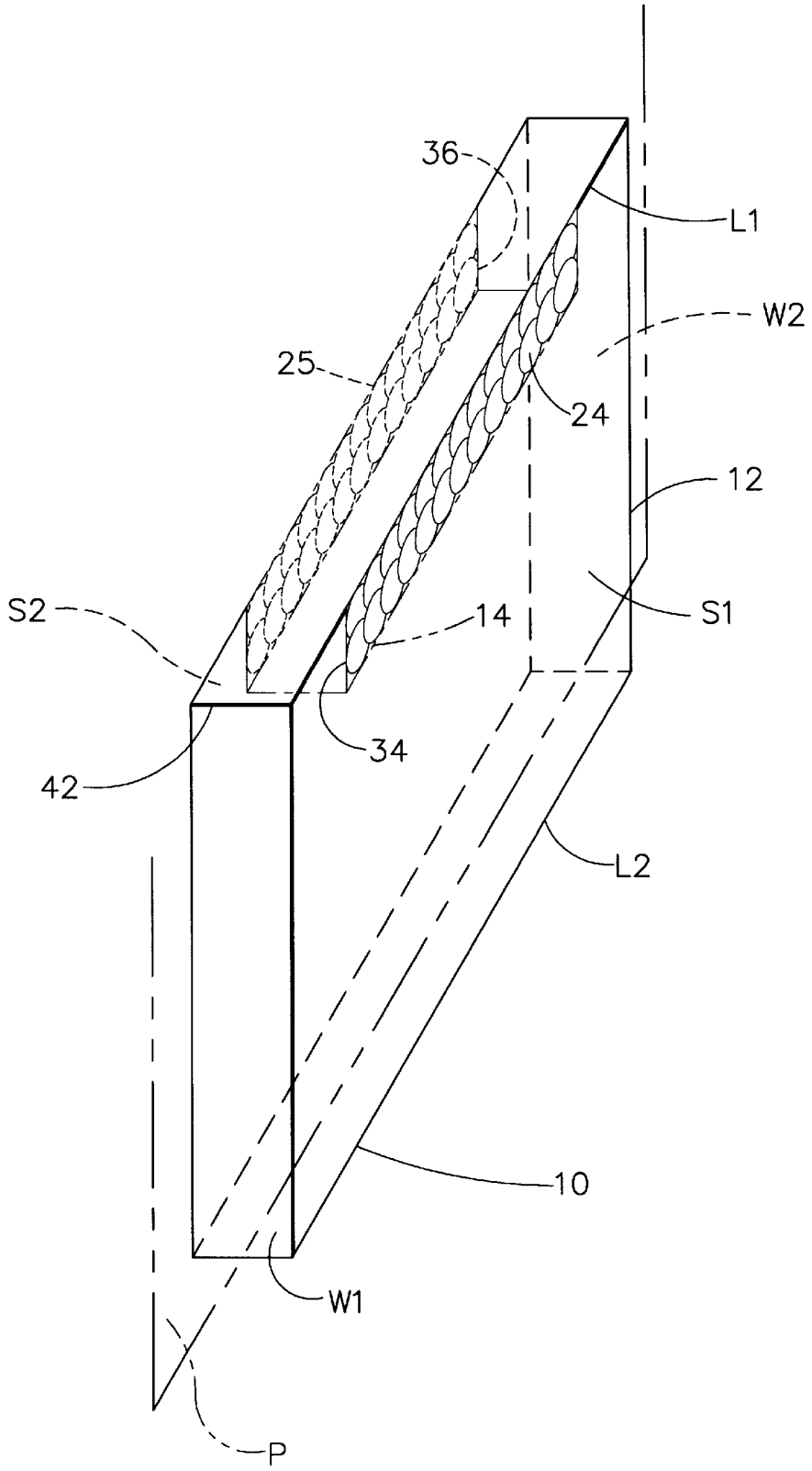
FIG. 1 is a schematic perspective view of a test coupon in accordance with an exemplary first embodiment of the present invention.
Figure 5:
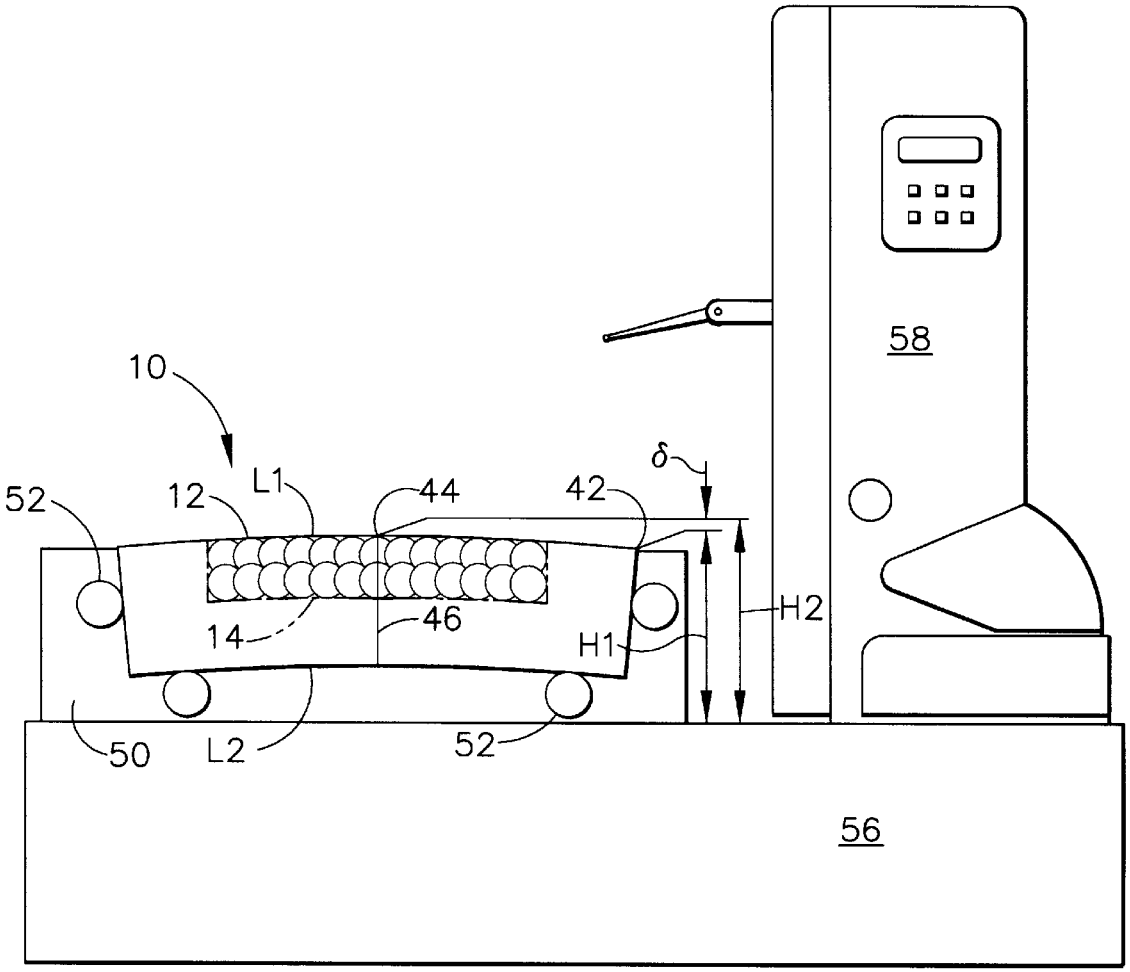
FIG. 5 is a schematic view of the test coupon of FIG. 1 fixtured to illustrate measuring a deflection of the coupon during a quality assurance inspection.

Illustrated in FIG. 1 is a schematic representation of a test coupon 10 used in a method for quality assurance of a laser process and more particularly a laser shock peening process. The test coupon 10 has a metal strip 12 with flat first and second sides S1 and S2, respectively. The metal strip 12 is preferably rectangularly-shaped and has first and second lengthwise edges L1 and L2 and first and second widthwise edges W1 and W2, respectively. The rectangularly-shaped metal strip 12 has a pre laser shock peened strip length L and a strip width WS such that the strip length is longer than the strip width. A patch 14 of the metal strip 12 is preferably laser shock peened on both the first and second sides S1 and S2, respectively, forming two substantially identical back to back and equally treated first and second laser shock peened surfaces 24 and 25, respectively, and first and second pre-stressed (laser shock peened) regions 34 and 36 having deep compressive residual stresses imparted by laser shock peening (LSP), which is illustrated in FIG. 5, extending into the patch 14 from the laser shock peened surfaces. The substantially identical back to back laser shock peened patch 14 causes the coupon to bend in a plane P defined by the flat first and second sides S1 and S2, respectively. This is in contrast to Almen strips that bend out of or perpendicular to such a plane.

Figure 2:
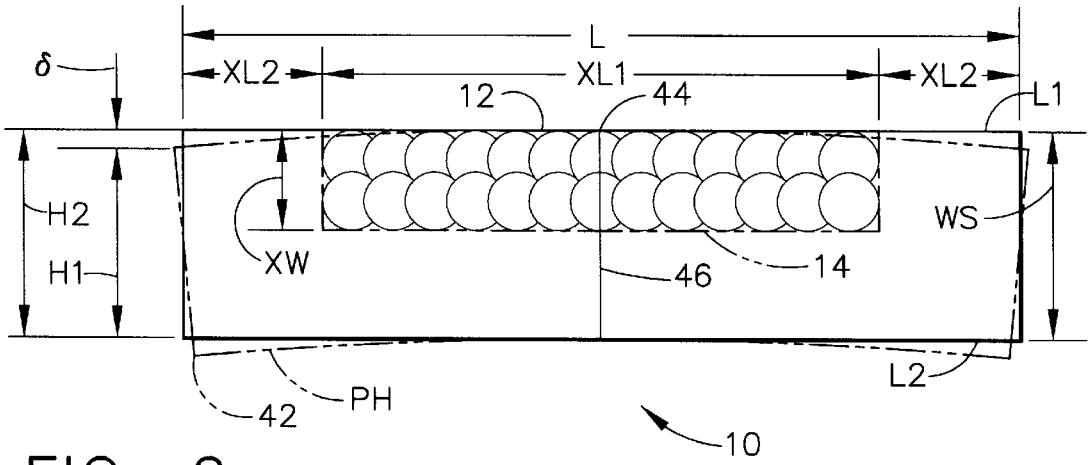
FIG. 2 is a schematic two dimensional view of the test coupon in FIG. 1 illustrating a deflection in accordance with the present invention.

One configuration of the exemplary test strip illustrated in FIGS. 1 and 2 is about 3 inches long, 0.75 inches wide, and 0.08 inches thick. The patch 14 has a patch length XL1 that is about 2 inches long along the first lengthwise edge L1 and has a patch width XW that is about 0.38 inches wide as measured inwardly from the first lengthwise edge. The metal strip 12 has two non-laser shock peened lengths XL2, respectively, that are about 0.5 inches long on either side of the patch 14. The metal strip 12 is made of a Titanium alloy, referred to in the industry as Ti 6-4, that is used in gas turbine engine fan blades for which the present invention was initially developed. Other metallic materials may be used but it is preferred to use the same material as the workpiece for which the quality assurance is being performed. Two stacked rows of overlapping laser shocked peened circular spots 158 having a diameter D are illustrated. This pattern is exemplary of one used for gas turbine engine blade leading edge.

The dimensions of the coupon, patch, and patch location may be optimized for a particular workpiece with the aid of finite element models of the residual stresses induced in the coupon to provide a consistently measurable deflection, preferably >0.005 inches, with the laser shock peening processing parameters used in production of the workpieces. Lower modulus metals will give more deflection for a given residual stress, but use of the actual metal being processed is preferred to match the response of the coupon to the LSP process with that of the actual workpiece.

A corner 42 of the strip 12, as illustrated in FIG. 2, serves to illustrate how in plane deflection or bending causes a deflection δ of a first portion (illustrated as corner 42) of the strip 12 from a position of the portion before the laser shock peening. The term deflection, for the purpose of this patent, is defined as bending or displacement of at least part of the strip. The deflection δ is very small having an order of magnitude on the order of 10 mils (0.01 inches) and the phantom line shape PH illustrates in an exaggerated manner the shape of the test coupon 10 after the patch 14 has been laser shock peened and how the corner 42 is deflected by from its position before the coupon is laser shock peened by an amount equal to that of the deflection δ. The deflection δ is formed by the laser shock peening and at least a part and preferably substantially all of the deflection lies in the plane P.

Different methods may be used to measure the deflection δ. One of these methods includes measuring the amount of the deflection δ of the corner 42 from a centerpoint 44 of the first lengthwise edge L1. The patch 14 is preferably centrally located about a mid-line 46 that is perpendicular to the first lengthwise edge L1 of the strip 12 and the coupon bends symmetrically about the mid-line.

Figure 6:
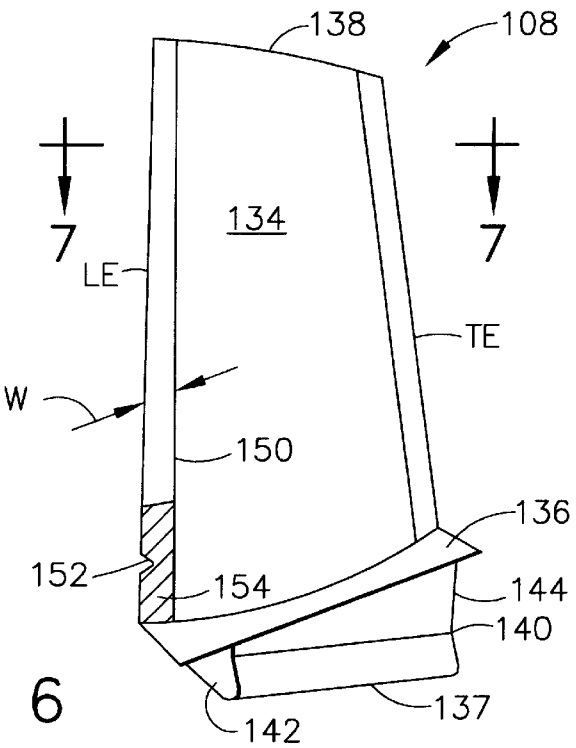
FIG. 6 is a perspective view of a fan blade exemplifying a workpiece for which the test coupon of the present invention may be used in a quality assurance inspection.

FIG. 5 illustrates how the deflection δ may be measured by placing the laser shock peened coupon 10 into a fixture 50 having pins 52 or other suitable means for centering and supporting the coupon evenly and symmetrically with respect to a reference surface such as a table top 56 so that the mid-line 46 is perpendicular to the table top. Measuring the deflection δ in the plane P is illustrated in FIG. 6 using the exaggerated shape of the coupon 10. Next, an electronic digital or other type of height gauge 58 is used to measure a first height H1 of the corner 42 and a second height H2 of the centerpoint 44 with respect to the table top 56. A difference between the first height H1 of the corner 42 and the second height H2 corner 42 is generally equal to the deflection δ because the strip 12 bends substantially symmetrically about the mid-line 46. The first height H1 of the corner 42 and the second height H2 corner 42 may both be measured and used either individually or averaged together. This method of measuring the deflection δ provides an accurate, fast, inexpensive, and real time procedure for quality assurance during production laser shock peening processes.

Figure 7:
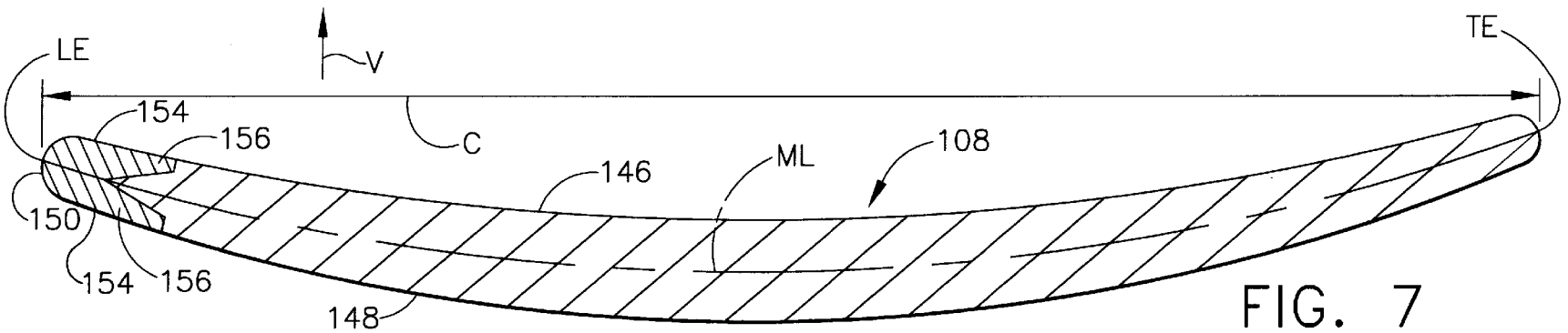
FIG. 7 is a cross-sectional view of the processed fan blade in FIG. 6.

Quality assurance is typically a go or no go, pass or fail, accept or reject type of analysis. The technique of the present invention involves quality assurance of the laser shock peening process on a production workpiece such as an exemplary aircraft turbofan gas turbine engine fan blade 108 illustrated in FIGS. 6 and 7. The fan blade 108 includes an airfoil 134 extending radially outward from a blade platform 136 to a blade tip 138. The fan blade 108 includes a root section 140 extending radially inward from the platform 136 to a radially inner end 137 of the root section 140. At the radially inner end 137 of the root section 140 is a blade root 142 which is connected to the platform 136 by a blade shank 144. The airfoil 134 extends in the chordwise direction between a leading edge LE and a trailing edge TE of the airfoil. A chord C of the airfoil 134 is the line between the leading edge LE and trailing edge TE at each cross-section of the blade as illustrated in FIG. 7. A pressure side 146 of the airfoil 134 faces in the general direction of rotation as indicated by an arrow V and a suction side 148 is on the other side of the airfoil and a mean-line ML is generally disposed midway between the two sides in the chordwise direction.

The fan blade 108 has a leading edge section 150 that extends along the leading edge LE of the airfoil 134 from the blade platform 136 to the blade tip 138. The leading edge section 150 includes a predetermined first width W such that the leading edge section 150 encompasses an area where nicks and tears that may occur along the leading edge of the airfoil 134 during engine operation. The airfoil 134 subject to a significant tensile stress field due to centrifugal forces generated by the fan blade 108 rotating during engine operation. The airfoil 134 is also subject to vibrations generated during engine operation and the nicks and tears operate as high cycle fatigue stress risers producing additional stress concentrations around them.

To counter fatigue failure of portions of the blade along possible crack lines that can develop and emanate from the nicks and tears at least one and preferably both of the pressure side 146 and the suction side 148 have laser shock peened blade surfaces 154 and a pre-stressed blade region 156 having deep compressive residual stresses imparted by laser shock peening (LSP) extending into the airfoil 134 from the laser shock peened surfaces as seen in FIG. 7. The pre-stressed blade regions 156 are illustrated along only a portion of the leading edge section 150 but may extend along the entire leading edge LE or longer portion thereof.

One particular embodiment of the present invention includes a correlation between the deflection δ and a predetermined failure mode of the production type of workpiece such as the blade 108. One correlation for the example presented herein is between the deflection δ and high cycle fatigue (HCF) of the blades 108 which are laser shock peened and notched before the HCF testing may be used to establish pass/fail criteria. A number of blades 108 or just one blade 108 may be notched and subjected to high cycle fatigue tests to establish the correlation. For each test, one laser shock peened blade 108 has a notch 152 placed in the leading edge LE about a predetermined position of the pre-stressed blade regions 156 after the blade is laser shock peened. The test coupon 10 is preferably also laser shock peened when the blade 108 is laser shock peened and, preferably, with the same pattern used on the blade. Then, the blade 108 is vibrated at high frequencies until it fails under HCF. The predetermined position of the notch 152 along the leading edge LE should correspond to where the blade fails under HCF during a resonant mode of failure of most concern to the blade designers such as the first, second or third resonant mode. If the blade does not fail within predetermined testing parameters or conditions, then, the deflection δ measured after the test coupon 10 is laser shock peened is an acceptable level for production and if it fails then it is not. Other laser shock peened blades and associated test coupons may also be similarly tested using varying laser shock peening parameters to establish bands of acceptable and unacceptable values for the deflection δ. These results can then be used during production runs for qualify assurance of the laser shock peening process. It is contemplated that one calibration can be used for an entire production run as long as the production laser shock peening parameters do not change.

Figure 8:
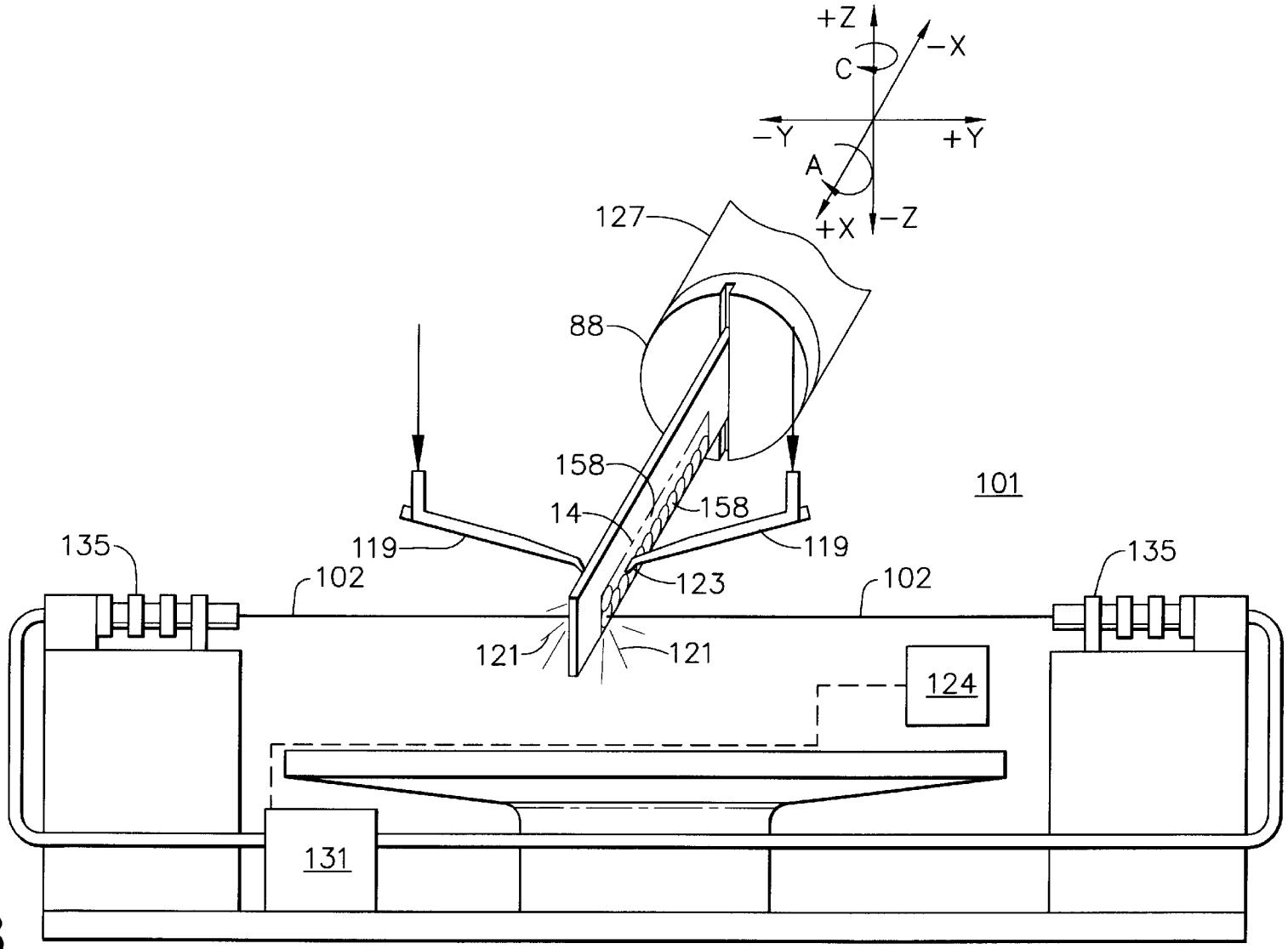
FIG. 8 is a schematic perspective view illustration of the test coupon of FIG. 1 mounted in a laser shock peening system in accordance with an exemplary use of the present invention.

Illustrated in FIG. 8 is a laser shock peening system 101 for laser shock peening the workpiece and with the test coupon 10. The test coupon 10 is mounted in a coupon holder 88 which is attached to a five-axis computer numerically controlled (CNC) manipulator 127, commercially available from the Huffman Corporation, having an office at 1050 Huffman Way, Clover, S.C. 29710. The five axes of motion that are illustrated in the exemplary embodiment are conventional translational axes X, Y, and Z, and conventional rotational axes A and C that are well known in CNC machining. The manipulator 127 is preferably used to move and position the test coupon 10 (as well as the blade 108 not shown in this FIG.) and to effect laser shock peening "on the fly" in accordance with a laser shock peening method and of the present invention. The manipulator 127 is used to continuously move and position the blade to provide laser shock peening "on the fly" in accordance with one embodiment of the present invention. Laser shock peening may be done in a number of various ways using paint or tape as an ablative medium (see—in particular U.S. Pat. No. 5,674,329 entitled "Adhesive Tape Covered Laser Shock Peening". The same laser shock peening apparatus is used in the laser shock peening process of the leading edge section 150 of the blade 108.

In accordance with a preferred embodiment of the present invention, the patch of the coupon 10 and the first and second laser shock peened surfaces 24 and 25, respectively, of the test coupon 10 are covered with an ablative coating such as paint or preferably adhesive tape 159 to form a coated surface 155 as disclosed in U.S. Pat. Nos. 5,674,329 and 5,674,328 to form laser shock peening coated surfaces 155 on the test coupon 10. In the exemplary embodiments illustrated herein, layers of adhesive tape 159 are used as the ablative coating. Other laser shock peening processes may paint the first and second laser shock peened surfaces 24 and 25 of the patch 14 for each sequence of laser shock peening firings. The paint and tape provide an ablative medium preferably over which is a clear containment medium which may be a clear fluid curtain such as a flow of water.

The laser beam shock induced deep compressive residual stresses may be produced by repetitively firing two high energy laser beams 102, each of which is defocused ± a few mils with respect to the coated surfaces 155 on both the first and second sides S1 and S2 of the test coupon 10. Each of the laser beams is preferably fired through a curtain of flowing water 121 that is flowed over the coated surfaces 155. The paint, tape, or other ablative layer 161 is ablated generating plasma which results in shock waves on the surface of the material. Other ablative materials may be used to coat the surface as suitable alternatives to paint. These coating materials include metallic foil or adhesive plastic tape as disclosed in U.S. Pat. Nos. 5,674,329 and 5,674,328. These shock waves are re-directed towards the coated surface 155 by the curtain of flowing water 121 to generate travelling shock waves (pressure waves) in the material below the coated surface. The amplitude and quantity of these shockwaves determine the depth and intensity of compressive stresses. The ablative coating is used to protect the target surface and also to generate plasma. The laser beam shock induced deep compressive residual stresses in the compressive pre-stressed regions 156 are generally about 50–150 KPSI (Kilo Pounds per Square Inch) extending from the first and second laser shock peened surfaces 24 and 25 to a depth of about 20–50 mils into the pre-stressed regions 156.

The test coupon 10 is continuously moved while continuously firing the stationary laser beams 102 through a curtain of flowing water 121 on the coated surfaces 155 and forming the spaced apart laser shock peened circular spots 158 (just as the blade 108 is laser shock peened during production and HCF testing and correlation). The curtain of water 121 is illustrated as being supplied by a conventional water nozzle 123 at the end of a conventional water supply tube 119. The laser shock peening system 101 has a conventional generator 131 with an oscillator 133 and a pre-amplifier 139A and a beam splitter 143 which feeds the pre-amplified laser beam into two beam optical transmission circuits each having a first and second amplifier 139 and 141, respectively, and optics 135 which include optical elements that transmit and focus the laser beam 102 on the coated surfaces 155. A controller 124 may be used to modulate and control the laser shock peening system 101 to fire the laser beams 102 on the coated surfaces 155 in a controlled manner. Ablated coating material is washed out by the curtain of flowing water 121.

Figure 9:
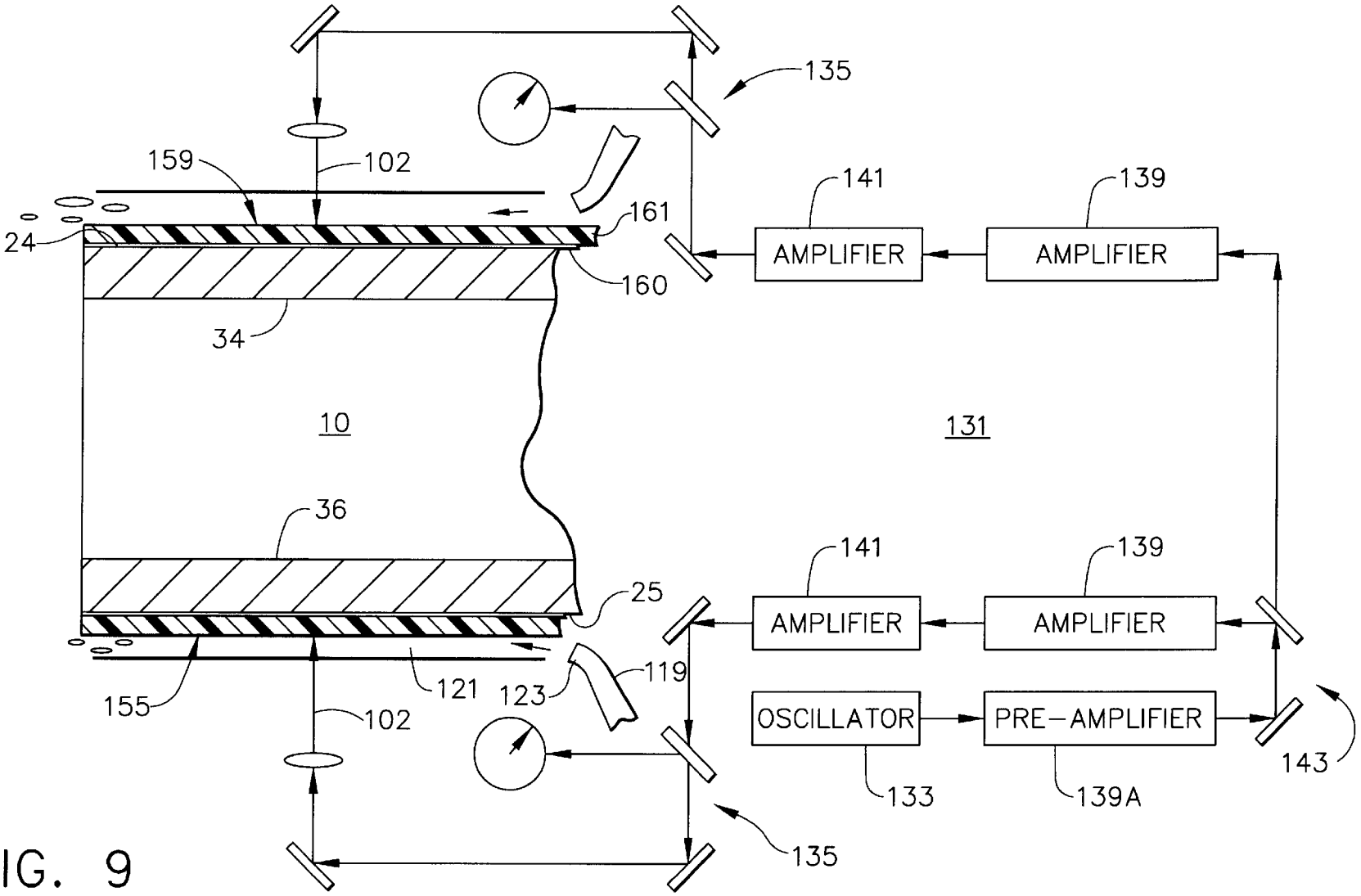
FIG. 9 is a partial cross-sectional and a partial schematic view of the setup in FIG. 8 particularly illustrating a portion around the patch of the coupon in FIGS. 1 and 2.

The present invention provides that the surface to be laser shock peened be adhesively covered with at least one layer of the tape 159 to provide the taped coated surface 155, though more than one layer is certainly contemplated by the present invention. Preferably, the tape 159 is self adhesive having an adhesive layer 160 of adhesive material and an ablative layer 161 of ablative material as illustrated in FIG. 9. Suitable materials for the ablative layer include plastic such as vinyl plastic film and foil. One suitable source for the tape 159 is SCOTCH BRAND NO. 471 PLASTIC FILM TAPE which can be had with a black pigmented vinyl plastic backing, about 4 mils thick, and has a rubber adhesive layer, about 1 mil thick. The ablative medium in the form of the tape 159 without an adhesive layer may also be used with a suitable adhesive material applied directly to the first and second laser shock peened surfaces 24 and 25. The tape 159 should be rubbed or otherwise pressed against the metallic material of the patch 14 to remove bubbles that may remain between the tape and the first and second laser shock peened surfaces 24 and 25.

The preferred embodiment of the method of the present invention includes continuously moving the blade while continuously firing the laser beam on the taped surface and adjacent laser shock peened circular spots may be hit in different sequences. However, the laser beam may be moved instead just so long as relative movement between the beam and the surface is effected.

Figure 10:
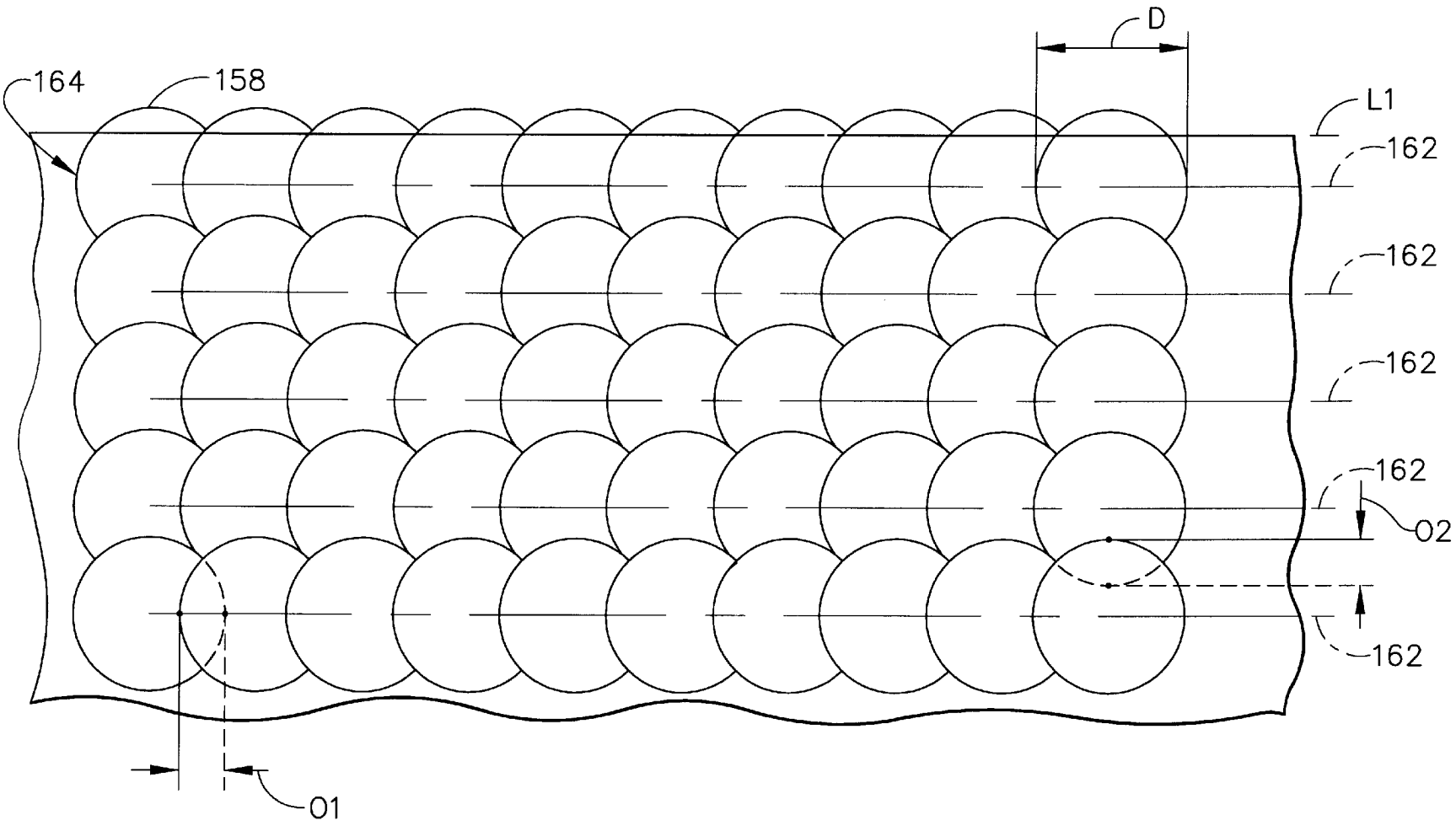
FIG. 10 is a schematic illustration of a pattern of laser shocked peened circular spots on a laser shock peened surface of the coupon in FIGS. 1 and 2.

In accordance with one embodiment of the present invention the first and second sides S1 and S2, respectively, of the patch 14 of the coupon 10 and the laser shock peened blade surface 154 (before it is laser shock peened) of the blade are covered by a layer of the adhesive tape 159 and then laser shock peened forming overlapping laser shocked peened circular spots 158 as illustrated in FIGS. 8 and 10. The preferred laser shock peening processes includes coating or taping the first and second sides S1 and S2, respectively, of the patch 14 for each sequence of laser shock peening firings. The paint and tape provide an ablative medium, preferably, over which is a clear containment medium which may be a clear fluid curtain such as a flow of water 121.

FIG. 10 illustrates an exemplary pattern of stacked rows of overlapping laser shocked peened circular spots 158 (indicated by the circles). All the laser shocked peened circular spots 158 with their corresponding centers X lie along a row centerline 162. The pattern of sequences entirely covers the laser shock peening coated surface 155. The laser shocked peened circular spots 158 have a diameter D in a row 164 of overlapping laser shock peened circular spots. The pattern may be of multiple overlapping rows 164 of overlapping shock peened circular spots on the laser shock peening coated surface 155. A first exemplary overlap, illustrated as about 30%, is between adjacent laser shock peened circular spots 158 in a given row. The overlap is typically defined by a first offset O1 between centers X of the adjacent laser shock peened circular spots 158 and though illustrated as 30% it can vary from about 30%–50% or more of the diameter D. A second overlap is between adjacent laser shock peened circular spots 158 in adjacent rows and is generally defined by a second offset O2 between adjacent row centerlines 162 and though illustrated as 30% it can vary from about 30%–50% of the diameter D depending on applications and the strength or fluency of the laser beam. The pattern is referred to as stacked because the centers X of adjacent spots 158 in adjacent rows are all linearly aligned. Other patterns are disclosed in the references, see U.S. Pat. Nos. 5,591,009, 5,674,329, and 5,674,328.

Several sequences may be required to produce the entire pattern and re-taping of the first and second sides S1 and S2, respectively, of the patch 14 is done between each sequence of laser firings. The workpiece blade 108 and the test coupon 10 are preferably laser shock peened in the same manner to form the same sequences and patterns of laser shock peened circular spots 158. The laser firing each sequence has multiple laser firings or pulses with a period between firings that is often referred to a "rep". During the rep, the part is moved so that the next pulse occurs at the location of the next laser shocked peened circular spot 158. Preferably, the part is moved continuously and timed to be at the appropriate location at the pulse or firing of the laser beam. One or more repeats of each sequence may be used to hit each laser shocked peened circular spot 158 more than once. This may also allow for less laser power to be used in each firing or laser pulse.

The fan blade 108 typically may have an airfoil about 11 inches long, a chord C about 3.5 inches, and laser shock peening blade surfaces 154 about 2 inches long along the leading edge LE. The laser shock peened blade surfaces 154 are about 0.5 inches wide (W). A first row 164 of laser shocked peened circular spots 158 nearest the leading edge LE extends beyond the leading edge by about 20% of the laser spot diameter D which is about 0.27" thus imparting deep compressive residual stresses in the pre-stressed blade region 156 below the laser shock peening blade surfaces 154 which extend about 0.5 inches from the leading edge.

Figure 3:
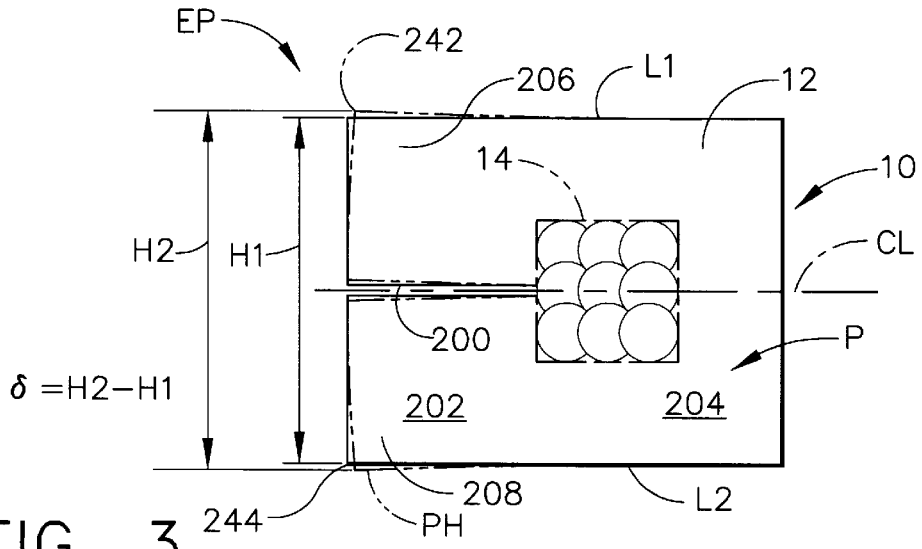
FIG. 3 is a schematic view of a test coupon in accordance with an exemplary second embodiment of the present invention.

Another embodiment of the test coupon 10 is also rectangularly-shaped and includes the strip 12 as illustrated in FIG. 3 having an alternative configuration. The metal strip 12 also has the flat first and second sides S1 and S2, respectively, the first and second lengthwise edges L1 and L2, and the first and second widthwise edges W1 and W2, respectively. A slit 200 extends lengthwise along an end portion EP of the length from the first widthwise edge W1 forming lengthwise bifurcated and non-bifurcated portions 202 and 204, respectively, of the strip 12. The bifurcated portion 202 includes first and second branches 206 and 208, respectively, separated by the slit 200. The patch 14 is disposed on the non-bifurcated portion 204 such that the patch extends lengthwise away from the slit 200. The slit 200 is preferably formed along a lengthwise strip centerline CL of the strip 12. The patch 14 of the metal strip 12 is preferably laser shock peened on both the first and second sides S1 and S2, respectively, forming two substantially identical back to back and equally treated first and second laser shock peened surfaces 24 and 25, respectively, and first and second pre-stressed regions 34 and 36 having deep compressive residual stresses imparted by laser shock peening (LSP) as is the configuration in FIG. 3. The patch 14 is preferably immediately adjacent to the slit 200. The deep compressive residual stresses imparted by laser shock peening cause the first and second branches 206 and 208 to deflect away from each other in the plane P of the test coupon 10. The phantom line shape PH illustrates in an exaggerated manner the shape of the test coupon 10 after the patch 14 has been laser shock peened.

Measuring the deflection δ in the plane P is illustrated in FIG. 3 using the exaggerated shape of the coupon 10. The deflection δ is preferably measured as a difference between the first height H1 of a first corner 242, in the phantom line shape PH position, of the first branch 206 and the second height H2 of a second corner 244 of the non-bifurcated portion 204 along the first lengthwise edge L1 with respect to a reference surface such as the table top 56 in FIG. 5. A difference between the first height H1 and the second height H2 is generally equal to the deflection δ because only the first and second branches 206 and 208 bend substantially. The deflection δ is preferably formed by the simultaneous and identical laser shock peening of both sides of the strip 12 such that substantially all of the deflection δ lies in the plane P.

A third embodiment of the rectangularly-shaped test coupon 10 is illustrated in FIG. 4 and includes the strip 12 having another alternative configuration. The metal strip 12 includes the flat first and second sides S1 and S2, respectively, the first and second lengthwise edges L1 and L2, and the first and second widthwise edges W1 and W2, respectively. Parallel slots 250 extend lengthwise along a middle portion MP of the strip 12 and are disposed inwardly of the first and second lengthwise edges L1 and L2, thus, forming first and second lengthwise extending bridges 252 and 254, respectively, between the first and second lengthwise edges and slots, respectively. The laser shock peened patch 14 is centered between the slots first and second lengthwise extending bridges 252 and 254. The phantom line shape PH illustrates in an exaggerated manner the elongated shape of the test coupon 10 after the patch 14 has been laser shock peened. The laser shock peened region causes a strain in the bridges because the deflection δ is a change in the length of the strip 12, a lengthwise elongation (either positive or negative) of the strip. Strain gauges 260 may be operably disposed on non-laser shock peened portions of the first and second sides S1 and S2 which is preferably on both the first and second lengthwise extending bridges 252 and 254 for a total of 4 strain gauges. It is contemplated that a pair or only one of the strain gauges 260 may used on only one of the first and second sides S1 and S2. Again a correlation for a QA process is established between HCF data on the type of workpiece and strain gauge measurements of the test coupons which indicates the deflection δ in the plane P. Once the correlation is established, then, the laser shock peening process may be run using the production workpieces with QA tests run on the test coupons periodically during the production run.

A variation of the third embodiment of the rectangularly-shaped test coupon 10 is illustrated in FIG. 4A and includes the strip 12 having another alternative configuration. The metal strip 12 has no slots and the laser shock peened patch 14 is centered on the strip. The deflection δ is measured directly by measuring the change in the length of the strip 12, lengthwise elongation (either positive or negative) of the strip. The deflection δ is equal to the difference between the (post) laser shock peened strip length L and a pre laser shock peened strip length L'. L is the length of the phantom line shape PH. The patch 14 may extend across the entire width of the strip 12.

While the preferred embodiment of the present invention has been described fully in order to explain its principles, it is understood that various modifications or alterations may be made to the preferred embodiment without departing from the scope of the invention as set forth in the appended claims.

We claim:

1. A method for quality control of a laser shock peening process, said method comprising the following steps:

mounting a test coupon in a laser shock peening apparatus wherein the coupon is a metallic strip having opposite first and second sides that generally define a plane of the strip, laser shock peening a patch of the strip and forming at least a first laser shock peened surface within the patch on at least one of the first and second sides wherein a first laser shocked region having deep compressive residual stresses imparted by the laser shock peening extends into the strip from the first laser shock peened surface, and wherein the shape of the coupon and location of the patch is such that said laser shock peening produces a measurable deflection of at least a portion of the strip and at least a part of said deflection lies in said plane, and measuring said deflection in said plane.

2. A method for quality control of a laser shock peening process, said method comprising the following steps:

mounting a test coupon in a laser shock peening apparatus wherein the coupon is a metallic strip having opposite first and second sides that generally define a plane of the strip, simultaneously laser shock peening first and second sides to form substantially identical first and second laser shock peened surfaces within a patch on the first and second sides respectively wherein first and second laser shocked regions having deep compressive residual stresses imparted by the laser shock peening extends into the strip from the first and second laser shock peened surface, and wherein the shape of the coupon and location of the patch is such that said laser shock peening produces a deflection that is substantially only in the plane.

3. A method as claimed in claim 2 wherein said laser shock peening is done asymmetrically with respect to a centerline of the strip such that the deflection includes a bending of at least a portion of the strip.

4. A method as claimed in claim 3 wherein the strip and sides are rectangular and have a length and width such that the length is longer than the width, and the patch is disposed asymmetrically with respect to a lengthwise centerline of the strip.

5. A method as claimed in claim 4 wherein:

the strip has lengthwise and widthwise edges which intersect at corners of the strip, the length and lengthwise edges are longer than the width and the widthwise edges, and the patch is disposed lengthwise midway along and extends widthwise inwardly from one of the lengthwise edges.

6. A method as claimed in claim 5 further comprising:

after the patch is laser shock peened the deflection is measured by measuring a widthwise difference in positions of at least one of the corners of the strip and a midpoint of the patch along the lengthwise edge.

7. A method as claimed in claim 2 wherein:

the strip and sides are rectangular and have a length and width and lengthwise and widthwise edges such that the length is longer than the width and the lengthwise edges are longer than the widthwise edges, the strip has a slit extending lengthwise a portion of the length from one of the widthwise edges forming lengthwise bifurcated and non-bifurcated portions of the strip, the bifurcated portion includes two branches separated by the slit of the strip, and the patch is disposed on the non-bifurcated portion of the strip.

8. A method as claimed in claim 7 wherein the two branches are substantially identical, the slit is formed along a centerline of the strip, and said laser shock peening is done symmetrically within respect to the centerline such that the deflection includes a bending of the branches.

9. A method as claimed in claim 8 wherein the patch extends lengthwise away from the slit.

10. A method as claimed in claim 9 further comprising:

after the patch is laser shock peened the deflection is measured by measuring a widthwise difference in positions of two of the corners of the strip on one of the lengthwise edges.

11. A method as claimed in claim 2 wherein:

the strip and sides are rectangular and have a length and width and lengthwise and widthwise edges such that the length is longer than the width and the lengthwise edges are longer than the widthwise edges, two parallel lengthwise extending slots are disposed through the strip, and the patch is centered between the slots.

12. A method as claimed in claim 11 further comprising a measuring step after the patch is laser shock peened wherein said step comprises measuring an indicator of lengthwise elongation due to the laser shock peening step.

13. A method as claimed in claim 12 wherein strain gauges are mounted on the sides of the coupon outside of the patch before the coupon is laser shock peened and the said measuring step comprises measuring strain indicated from the strain gauges after the laser shock peening.

14. A method as claimed in claim 13 wherein strain gauges are mounted between the slots and the lengthwise edges.

15. A method as claimed in claim 2 wherein said laser shock peening includes firing a laser beam to apply a pattern of overlapping laser beam spots at the surfaces wherein the pattern is also applied to a workpiece undergoing a laser shock peening process.

16. A method as claimed in claim 15 wherein the pattern is one of a series of patterns applied to the workpiece undergoing the laser shock peening process.

17. A method as claimed in claim 15 further comprising a step of comparing the deflection to a correlation of a deflection indicating parameter and high cycle fatigue failure of a high cycle fatigue test piece of the workpiece for accepting or rejecting the workpiece.

18. A method as claimed in claim 2 further comprising a step of comparing the deflection to a correlation of a deflection indicating parameter and high cycle fatigue failure of a high cycle fatigue test piece of the workpieces for accepting or rejecting the workpieces.

19. A method as claimed in claim 6 wherein said laser shock peening includes firing a laser beam to apply a pattern of overlapping laser beam spots at the surfaces wherein the pattern is also applied to a workpiece undergoing a laser shock peening process.

20. A method as claimed in claim 19 further comprising a step of comparing the deflection to a correlation of a deflection indicating parameter and high cycle fatigue failure of a high cycle fatigue test piece of the workpieces for accepting rejecting the workpieces.

21. A method as claimed in claim 14 wherein said laser shock peening includes firing a laser beam to apply a pattern of overlapping laser beam spots at the surfaces wherein the pattern is also applied to a workpiece undergoing a laser shock peening process.

22. A method as claimed in claim 15 wherein the pattern is one of a series of patterns applied to the workpiece undergoing the laser shock peening process.

23. A method as claimed in claim 22 further comprising a step of comparing the deflections measured of at least some workpieces to a correlation of a deflection indicating parameter and high cycle fatigue failure of a high cycle fatigue test piece of the workpiece for accepting or rejecting the workpieces.

* * * * *